US010332454B2

(12) United States Patent
He et al.

(10) Patent No.: US 10,332,454 B2
(45) Date of Patent: Jun. 25, 2019

(54) PIXEL DRIVE CIRCUIT AND CONTROL METHOD THEREOF, DISPLAY PANEL AND DISPLAY DEVICE

(71) Applicant: SHANGHAI TIANMA MICRO-ELECTRONICS CO., LTD., Shanghai (CN)

(72) Inventors: Zeshang He, Shanghai (CN); Tianyi Wu, Shanghai (CN); Junhui Lou, Shanghai (CN)

(73) Assignee: SHANGHAI TIANMA MICRO-ELECTRONICS CO., LTD., Shanghai (CN)

( * ) Notice: Subject to any disclaimer, the term of this patent is extended or adjusted under 35 U.S.C. 154(b) by 0 days.

(21) Appl. No.: 15/865,202

(22) Filed: Jan. 8, 2018

(65) Prior Publication Data

US 2018/0130419 A1 May 10, 2018

(30) Foreign Application Priority Data

Aug. 15, 2017 (CN) ..... 2017 1 0695485

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01); *G09G 2300/0823* (2013.01); *G09G 2300/0842* (2013.01); *G09G 2300/0861* (2013.01); *G09G 2310/0256* (2013.01);
(Continued)

(58) Field of Classification Search
CPC ..... G09G 3/3258; G09G 2320/045; G09G 2300/0823; G09G 3/3283; G09G 3/3291
See application file for complete search history.

(56) References Cited

U.S. PATENT DOCUMENTS

2016/0314742 A1* 10/2016 Zhou ..... G09G 3/3258
2017/0256202 A1* 9/2017 Sun ..... G09G 3/32

FOREIGN PATENT DOCUMENTS

CN 1474371 A 2/2004
CN 103531148 A 1/2014
CN 105679236 A 6/2016

OTHER PUBLICATIONS

First Office Action dated Jan. 28, 2019 in the corresponding Chinese Application (application No. 201710695485.4).

* cited by examiner

*Primary Examiner* — Dennis P Joseph

(74) *Attorney, Agent, or Firm* — Kilpatrick Townsend & Stockton LLP

(57) ABSTRACT

Provided is a pixel drive circuit including: a first transistor, configured to transmit a signal of a first power source voltage end to a first node in response to an enable signal of a light-emitting signal control end; a first drive transistor, configured to generate a drive current on a conduction path from the first node to a third node according to an enable signal of a second node, the first drive transistor being an N-type transistor; a second drive transistor, configured to generate a drive current on the conduction path from the first node to the third node according to an enable signal of the second node, the second drive transistor being a P-type transistor; and a second transistor, configured to transmit a signal of a polarity switching signal end to the second node in response to an enable signal of a first scan signal end.

14 Claims, 10 Drawing Sheets

(52) U.S. Cl.
CPC ..... *G09G 2310/0262* (2013.01); *G09G 2310/0291* (2013.01); *G09G 2320/043* (2013.01); *G09G 2320/045* (2013.01)

PIXEL DRIVE CIRCUIT AND CONTROL METHOD THEREOF, DISPLAY PANEL AND DISPLAY DEVICE

CROSS-REFERENCE TO RELATED APPLICATIONS

The present application claims the benefit of priority to Chinese Patent Application No. 201710695485.4, filed on Aug. 15, 2017, the content of which is incorporated herein by reference in its entirety.

TECHNICAL FIELD

The present invention relates to the field of display technologies and, particularly, relates to a pixel drive circuit and a control method thereof, a display panel and a display device.

BACKGROUND

In an organic light-emitting display panel, a pixel drive circuit is provided corresponding to each light-emitting element, for driving the light-emitting element to emit light.

In the related art, a pixel drive circuit includes a first thin film transistor, a second thin film transistor, a third thin film transistor, a drive transistor, a storage capacitor and a light-emitting element. A first power source voltage end is used for providing a first power source voltage. A second power source voltage end is used for providing a second power source voltage. A data line is used for providing a data signal. A scan signal end is used for providing a scan signal. A light-emitting signal control end is used for providing a light-emitting control signal. In a driving process, in a first stage, the scan signal end provides an enable signal, the light-emitting signal control end provides a non-enable signal, and the signal provided by the data line is transmitted to a first node via the first thin film transistor. Meanwhile, the first node and a second node are conducted by the drive transistor and the second thin film transistor for threshold compensation, such that a potential at the second node is a voltage provided by the data line plus a threshold voltage of the drive transistor. In a second stage, the scan signal end provides a non-enable signal, and the light-emitting signal control end provides an enable signal. A drive current is generated under control of the drive transistor to drive the light-emitting element to emit light. Since a gate voltage of the drive transistor is a voltage provided by the data line plus a threshold voltage of the drive transistor, according to a calculation formula of the drive current, an influence of the threshold voltage can be offset, such that the magnitude of the drive current is not related to the threshold voltage. However, the influence of the threshold voltage is merely offset theoretically, and the actual drive current is still related to the threshold voltage to a certain extent. In the working process of the drive transistor, since a control end of the drive transistor is influenced by the voltage with a same polarity for a long time, the threshold voltage is consistently drifted toward a same direction, and thus display defects are caused.

SUMMARY

Embodiments of the present invention provide a pixel drive circuit and a control method thereof, a display panel and a display device, which can reduce the probability that the threshold voltage of a drive transistor generates drifting, thereby improving poor display caused therefrom.

Embodiments of the present invention provide a pixel drive circuit. The pixel drive circuit includes: a first transistor, a first drive transistor, a second drive transistor, a storage capacitor, a second transistor, a compensation module and a light-emitting element. The first transistor is configured to transmit a signal of a first power source voltage end to a first node in response to an enable signal of a light-emitting signal control end. The first drive transistor is configured to generate a drive current on a conduction path from the first node to a third node according to an enable signal of a second node. The first drive transistor is an N-type transistor. The second drive transistor is configured to generate a drive current on the conduction path from the first node to the third node according to an enable signal of the second node. The second drive transistor is a P-type transistor. The storage capacitor is configured to maintain a voltage of the second node. The second transistor is configured to transmit a signal of a polarity switching signal end to the second node in response to an enable signal of a first scan signal end. The compensation module is configured to enable a signal of a data line to flow to the second node passing through the first drive transistor or the second drive transistor in response to an enable signal of a second scan signal end. An anode of the light-emitting element being coupled to the third node, and a cathode of the light-emitting element being electrically connected to a second power source voltage end.

In another aspect, embodiments of the present invention further provide a display device. The display device includes a display panel. The display panel includes a pixel drive circuit, and the pixel drive circuit includes: a first transistor, a first drive transistor, a second drive transistor, a storage capacitor, a second transistor, a compensation module and a light-emitting element. The first transistor is configured to transmit a signal of a first power source voltage end to a first node in response to an enable signal of a light-emitting signal control end. The first drive transistor is configured to generate a drive current on a conduction path from the first node to a third node according to an enable signal of a second node. The first drive transistor is an N-type transistor. The second drive transistor is configured to generate a drive current on the conduction path from the first node to the third node according to an enable signal of the second node. The second drive transistor is a P-type transistor. The storage capacitor is configured to maintain a voltage of the second node. The second transistor is configured to transmit a signal of a polarity switching signal end to the second node in response to an enable signal of a first scan signal end. The compensation module is configured to enable a signal of a data line to flow to the second node passing through the first drive transistor or the second drive transistor in response to an enable signal of a second scan signal end. An anode of the light-emitting element being coupled to the third node, and a cathode of the light-emitting element being electrically connected to a second power source voltage end.

In still another aspect, embodiments of the present invention further provide a control method for a pixel drive circuit, applied in the pixel drive circuit mentioned in the above aspect. The method includes: providing, in a first polarity frame, a first polarity voltage to the polarity switching signal end, in which the first polarity frame sequentially comprises a first stage, a second stage and a third stage. The method further includes: providing, in a second polarity frame, a second polarity voltage with a polarity opposite to the first polarity voltage to the polarity switching signal end, in which the second polarity frame sequentially comprises a first stage, a second stage and a third stage. The method further includes: providing, in the first stage, an enable signal to the first scan signal end, a non-enable signal to the second scan signal end, and a non-enable signal to the light-emitting signal control end. The method further includes: providing, in the second stage, a non-enable signal to the first scan signal end, an enable signal to the second scan signal end, and a non-enable signal to the light-emitting signal control end. The method further includes: providing, in the third stage, a non-enable signal to the first scan signal end, a non-enable signal to the second scan signal end, and an enable signal to the light-emitting signal control end.

According to the pixel drive circuit and the control method thereof, the display panel and the display device in the embodiments of the present invention, two drive transistors can alternately work in different frames. The problem that a same drive transistor being influenced by a bias voltage of a same direction is prevented, such that the probability that the threshold voltage of the drive transistor being consistently drifted toward the same direction is reduced, and the influence on a threshold compensation effect caused by consistent drifting of the threshold voltage of the drive transistor toward the same direction is reduced. Therefore, poor display caused by the consistent drifting of the threshold voltage of the drive transistor toward the same direction is improved.

BRIEF DESCRIPTION OF DRAWINGS

In order to illustrate technical solutions in embodiments of the present invention more clearly, a brief introduction of the drawings used in the embodiments or the related art will be provided herein. Obviously, the drawings described below are merely some embodiments of the present invention, and those skilled in the art can also obtain other drawings according to these drawings without creative work.

DESCRIPTION OF EMBODIMENTS

In order to clarify the objects, technical solutions and advantages of the present invention, the technical solutions in the embodiments of the present invention will be clearly and completely described with reference to the drawings in the embodiments of the present discourse. It is obvious that the embodiments described are only a part of embodiments of the present invention, rather than all of the embodiments. Based on the embodiments in the present invention, all other embodiments obtained by those skilled in the art without creative work shall belong to the protection scope of the present invention.

The terms used in the embodiments of the present invention are only for describing specific embodiments, which are not intended to limit the present invention. The singular form of 'a', 'an', 'the' and 'said' used in the embodiments and claims of the present invention and the appended claims is intended to include the plural form, unless otherwise clearly indicated in the context.

Figure 1:
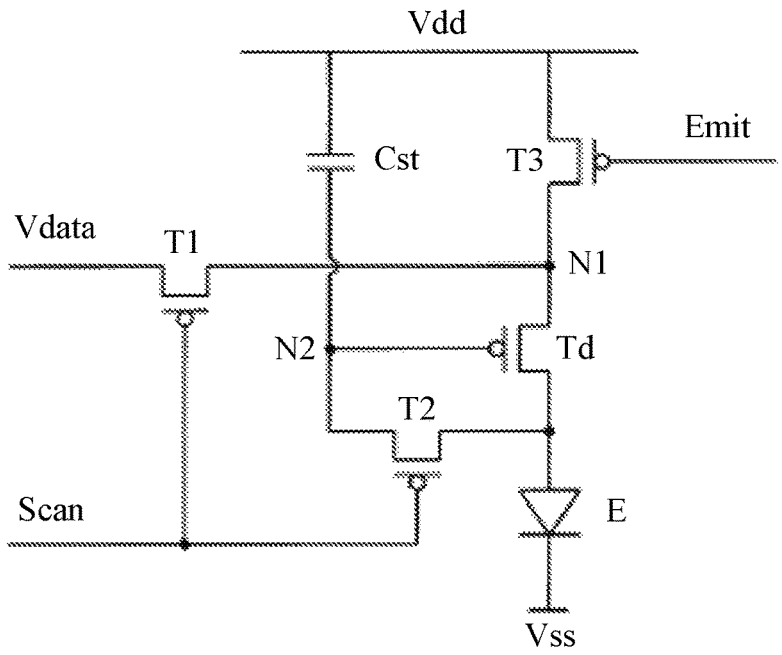
FIG. 1 (Prior art)
FIG. 1 is a circuit schematic diagram of a pixel drive circuit in the related art.
Figure 2:
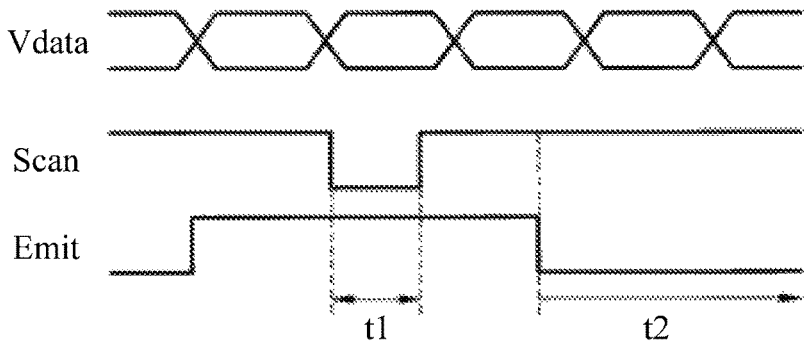
FIG. 2 (Prior art)
FIG. 2 is a sequence signal diagram corresponding to the pixel drive circuit in FIG. 1.

As shown in FIGS. 1 and 2, FIG. 1 is a circuit schematic diagram of a pixel drive circuit in the related art, and FIG. 2 is a sequence signal diagram corresponding to the pixel drive circuit in FIG. 1. The pixel drive circuit includes a first thin film transistor T1, a second thin film transistor T2, a third thin film transistor T3, a drive transistor Td, a storage capacitor Cst and a light-emitting element E. A first power source voltage end Vdd is used for providing a first power source voltage. A second power source voltage end Vss is used for providing a second power source voltage. A data line Vdata is used for providing a data signal. A scan signal end Scan is used for providing a scan signal. A light-emitting signal control end Emit is used for providing a light-emitting control signal. In a driving process, in a first stage t1, the scan signal end Scan provides an enable signal, the light-emitting signal control end Emit provides a non-enable signal, and the signal provided by the data line Vdata is transmitted to a first node N1 via the first thin film transistor T1. Meanwhile, the first node N1 and a second node N2 are conducted by the drive transistor Td and the second thin film transistor T2 for threshold compensation, such that a potential at the second node N2 is Vdata+Vth, in which Vdata is the signal provided by the data line Vdata, and Vth is a threshold voltage of the drive transistor Vd. In a second stage t2, the scan signal end Scan provides a non-enable signal, and the light-emitting signal control end Emit provides an enable signal. A drive current is generated under control of the drive transistor Td to drive the light-emitting element E to emit light. Since a gate voltage of the drive transistor Td is Vdata+Vth, according to a calculation formula of the drive current, an influence of the threshold voltage Vth can be offset, such that the magnitude of the drive current is not related to the threshold voltage Vth. However, the influence of the threshold voltage Vth is merely offset theoretically, and the actual drive current is still related to the threshold voltage Vth to a certain extent. In the working process of the drive transistor Td, since a control end of the drive transistor Td is influenced by the voltage with a same polarity for a long time, the threshold voltage Vth is consistently drifted toward a same direction, and thus display defects are caused.

Figure 3:
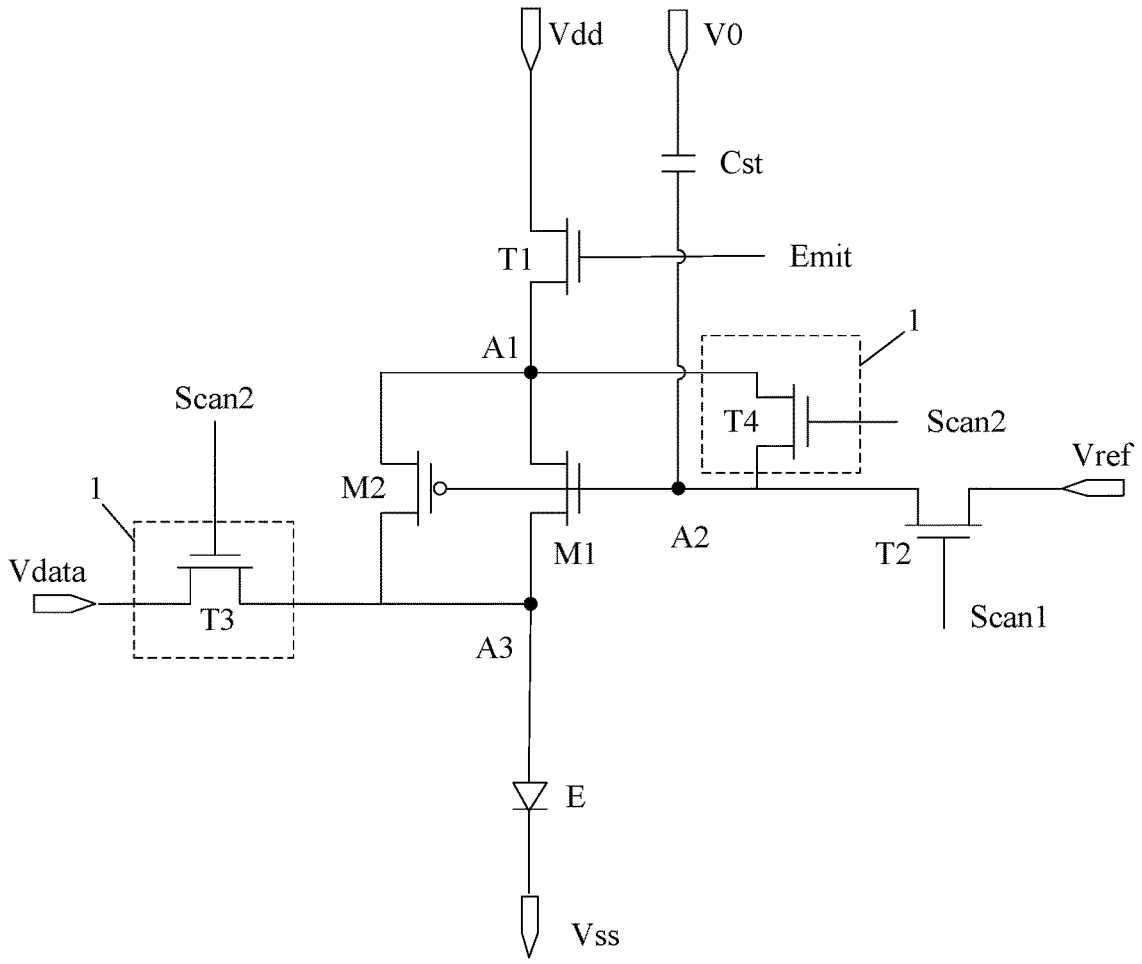
FIG. 3 is a schematic diagram of a pixel drive circuit in an embodiment of the present invention.

As shown in FIG. 3, FIG. 3 is a schematic diagram of a pixel drive circuit in an embodiment of the present invention. An embodiment of the present invention provides a pixel drive circuit, including a first transistor T1, used for transmitting a signal of a first power source voltage end Vdd to a first node A1 in response to an enable signal of a light-emitting signal control end Emit; a first drive transistor M1, used for generating a drive current on a conduction path between the first node A1 and a third node A3 according to the enable signal of a second node A2, the first drive transistor M1 being an N-type transistor; a second drive transistor M2, used for generating a drive current on a conduction path between the first node A1 and the third node A3 according to the enable signal of the second node A2, the second drive transistor M2 being a P-type transistor; a storage capacitor Cst, used for maintaining a voltage of the second node A2; a second transistor T2, used for transmitting a signal of a polarity switching signal end Vref to the second node A2 in response to an enable signal of a first scan signal end Scan1; a compensation module 1, used for enabling a signal of a data line Vdata to flow to the second node A2 passing through the first drive transistor M1 or the second drive transistor M2 in response to an enable signal of a second scan signal end Scan2; and a light-emitting element E, an anode thereof being coupled to the third node A3, and a cathode thereof being electrically connected to a second power source voltage end Vss.

Figure 4:
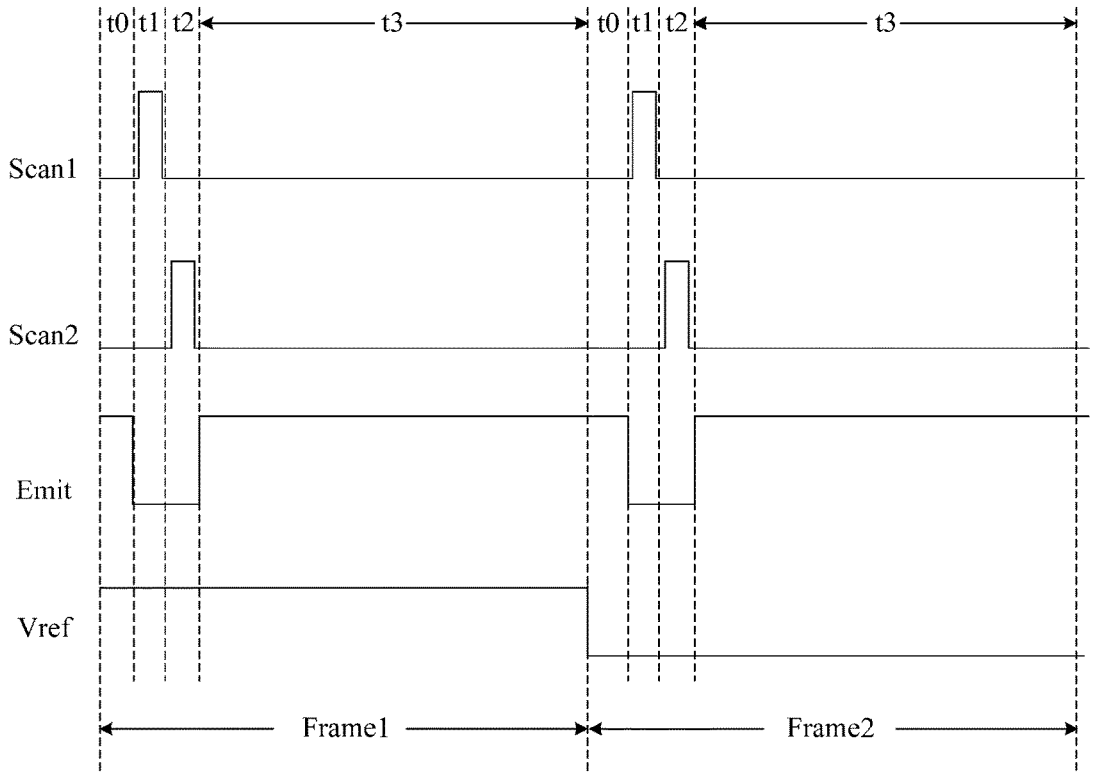
FIG. 4 is a sequence signal diagram of each end in the pixel drive circuit in FIG. 3.

As shown in FIG. 4, which is a sequence signal diagram of each end in the pixel drive circuit in FIG. 3, an embodiment of the present invention provides a method for controlling a pixel drive circuit, which includes:

A first polarity frame Frame1 and a second polarity frame Frame2. Each of the first polarity frame Frame1 and the second polarity frame Frame2 sequentially includes a first stage t1, a second stage t2 and a third stage t3. In the first polarity frame Frame1, a first polarity voltage (shown as a high level in FIG. 4) is provided to the polarity switching signal end Vref, and for example, when the first polarity voltage is a positive polarity voltage, Vref may be 8V. In the second polarity frame Frame2, a second polarity voltage with a polarity opposite to the first polarity voltage is provided to the polarity switching signal end Vref, and for example, when the second polarity voltage is a negative polarity voltage, Vref may be −8V. In the first stage t1, an enable signal is provided to the first scan signal end Scan1, a non-enable signal is provided to the second scan signal end Scan2, and a non-enable signal is provided to the light-emitting signal control end Emit. In the second stage t2, the non-enable signal is provided to the first scan signal end Scan1, the enable signal is provided to the second scan signal end Scan2, and the non-enable signal is provided to the light-emitting signal control end Emit. In the third stage t3, the non-enable signal is provided to the first scan signal end Scan1, the non-enable signal is provided to the second scan signal end Scan2, and the enable signal is provided to the light-emitting signal control end Emit.

In the first polarity frame Frame1, when in the first stage t1, the enable signal is provided to the first scan signal end Scan1, such that the second transistor T2 is turned on, the signal provided by the polarity switching signal end Vref is transmitted to the second node A2, at this moment, a potential of the second node A2 is Vref, and the Vref is of a positive polarity. In the second stage t2, the non-enable signal is provided to the first scan signal end Scan1, such that the second transistor T2 is turned off, at this moment, due to the action of the storage capacitor Cst, the potential of the second node A2 is maintained to be the Vref, the enable signal is provided to the second scan signal end Scan2, and due to the positive polarity of the Vref, the first drive transistor M1 is turned on, and the second drive transistor M2 is turned off, such that a signal of the data line Vdata flows to the second node A2 passing through the first drive transistor M1. The storage capacitor Cst discharges, such that the potential of the second node A2 is dropped to be Vdata+Vth1, the Vdata is the signal of the data line Vdata, and the Vth1 is a threshold voltage of the first drive transistor M1. Since the first drive transistor M1 is an N-type transistor, the Vth1 is a positive value. In the third stage t3, the non-enable signal is provided to the first scan signal end Scan1, such that the second transistor T2 is turned off, and at this moment, due to the action of the storage capacitor Cst, the potential of the second node A2 is maintained to be Vdata+Vth1, the enable signal is provided to the light-emitting signal control end Emit, such that the first transistor T1 is turned on, and due to the positive value of the Vth1, the potential of the second node A2 is the enable signal of the first drive transistor M1, such that the first drive transistor M1 generates a drive current, and the potential of the second node A2 is the non-enable signal of the second drive transistor M2, such that the second drive transistor M2 is turned off, and at this moment, the first drive transistor M1 and the second drive transistor M2 are in a positive bias voltage state. In the second polarity frame Frame2, when in the first stage t1, the enable signal is provided to the first scan signal end Scan1, such that the second transistor T2 is turned on, the signal provided by the polarity switching signal end Vref is transmitted to the second node A2, at this moment, a potential of the second node A2 is Vref, and the Vref is of a negative polarity. In the second stage t2, the non-enable signal is provided to the first scan signal end Scan1, such that the second transistor T2 is turned off, at this moment, due to the action of the storage capacitor Cst, the potential of the second node A2 is maintained to be the Vref, the enable signal is provided to the second scan signal end Scan2, and due to the negative polarity of the Vref, the second drive transistor M2 is turned on, and the first drive transistor M1 is turned off, such that a signal of the data line Vdata flows to the second node A2 passing through the second drive transistor M2, the storage capacitor Cst is charged, such that the potential of the second node A2 is risen to be Vdata+Vth2, the Vdata is the signal of the data line Vdata, and the Vth2 is a threshold voltage of the second drive transistor M2. Since the second drive transistor M2 is a P-type transistor, the Vth2 is a negative value. In the third stage t3, the non-enable signal is provided to the first scan signal end Scan1, such that the second transistor T2 is turned off, and at this moment, due to the action of the storage capacitor Cst, the potential of the second node A2 is maintained to be Vdata+Vth2, the enable signal is provided to the light-emitting signal control end Emit, such that the first transistor T1 is turned on, and due to the negative value of the Vth2, the potential of the second node A2 is the enable signal of the second drive transistor M2, such that the second drive transistor M2 generates a drive current, the potential of the second node A2 is the non-enable signal of the first drive transistor M1, such that the first drive transistor M1 is turned off, and at this moment, the first drive transistor M1 and the second drive transistor M2 are in a negative bias voltage state.

According to the pixel drive circuit and the control method thereof in the embodiments of the present invention, the two drive transistors can alternately work in different frames. The problem that a same drive transistor being influenced by a bias voltage of a same direction is prevented, such that the probability that the threshold voltage of the drive transistor being consistently drifted toward the same direction is reduced, and the influence on a threshold compensation effect caused by consistent drifting of the threshold voltage of the drive transistor toward the same direction is reduced. Therefore, poor display caused by the consistent drifting of the threshold voltage of the drive transistor toward the same direction is improved.

In an embodiment, as shown in FIG. 3, the compensation module 1 includes a third transistor T3, a first end thereof being electrically connected to the data line Vdata, a second end thereof being electrically connected to the third node A3, and a control end thereof being electrically connected to the second scan signal end Scan2 and used for transmitting the signal of the data line Vdata to the third node A3 in response to the enable signal of the second scan signal end Scan2; and a fourth transistor T4, a first end thereof being electrically connected to the first node A1, a second end thereof being electrically connected to the second node A2, and a control end thereof being electrically connected to the second scan signal end Scan2 and used for conducting the first node A1 with the second node A2 in response to the enable signal of the second scan signal end Scan2.

In the second stage t2, the enable signal is provided to the second scan signal end Scan2, such that both the third transistor T3 and the fourth transistor T4 are turned on, and at this moment, the signal of the data line Vdata flows to the third node A3 passing through the third transistor T3, then flows to the first node A1 from the third node A3 passing through the first drive transistor M1 or the second drive transistor M2, and then flows to the second node A2 from the first node A1 passing through the fourth transistor T4. In all other stages expect for the second stage t2, the second scan signal end Scan2 provides the non-enable signal. Therefore, both the third transistor T3 and the fourth transistor T4 are turned off, and other driving processes all have been explained in the above embodiments and are not repeated here. It should be noted that when both in the same control type, the third transistor T3 and the fourth transistor T4 are easiest to control, since the third transistor T3 and the fourth transistor T4 have the totally same turning on and turning off timing. Therefore, the third transistor T3 and the fourth transistor T4 can be provided to be both N-type transistors or both P-type transistors.

Figure 5:
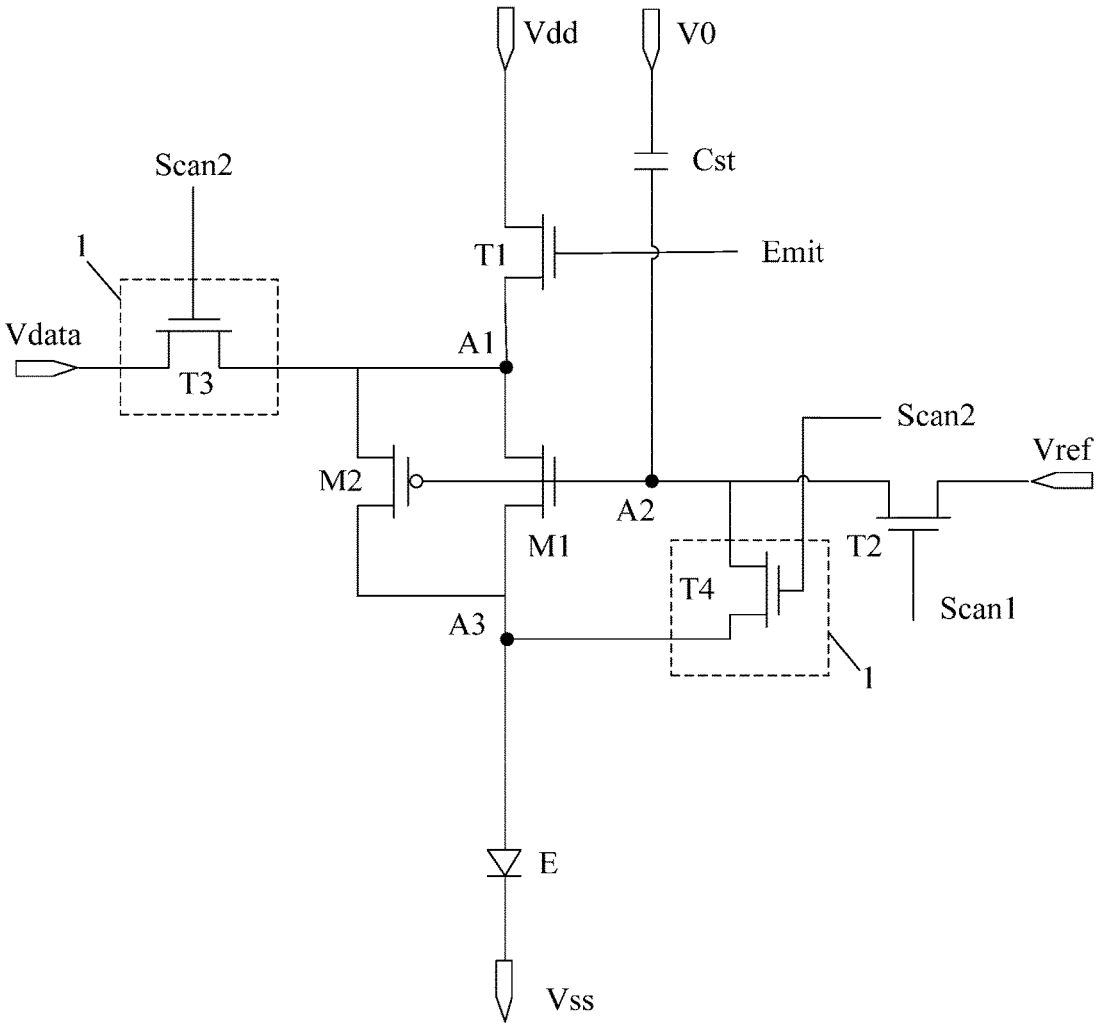
FIG. 5 is a schematic diagram of another pixel drive circuit in an embodiment of the present invention.

In an embodiment, as shown in FIG. 5, which is a schematic diagram of another pixel drive circuit in an embodiment of the present invention, the compensation module 1 includes a third transistor T3, a first end thereof being electrically connected to the data line Vdata, a second end thereof being electrically connected to the first node A1, and a control end thereof being electrically connected to the second scan signal end Scan2 and used for transmitting the signal of the data line Vdata to the first node A1 in response to the enable signal of the second scan signal end Scan2; and a fourth transistor T4, a first end thereof being electrically connected to the third node A3, a second end thereof being electrically connected to the second node A2, and a control end thereof being electrically connected to the second scan signal end Scan2 and used for conducting the third node A3 with the second node A2 in response to the enable signal of the second scan signal end Scan2.

The sequence signal as shown in FIG. 4 may also be applied to the pixel drive circuit as shown in FIG. 5. In the second stage t2, the enable signal is provided to the second scan signal end Scan2, such that both the third transistor T3 and the fourth transistor T4 are turned on, at this moment, the signal of the data line Vdata flows to the first node A1 passing through the third transistor T3, then flows to the third node A3 from the first node A1 passing through the first drive transistor M1 or the second drive transistor M2, and then flows to the second node A2 from the third node A3 passing through the fourth transistor T4. In other stages expect for the second stage t2, the second scan signal end Scan2 provides the non-enable signal. Therefore, both the third transistor T3 and the fourth transistor T4 are turned off, and other driving processes all have been explained in the above embodiments and are not repeated here. It should be noted that when both in the same control type, the third transistor T3 and the fourth transistor T4 are easier to control, since the third transistor T3 and the fourth transistor T4 have the totally same turning on and turning off timing. Therefore, the third transistor T3 and the fourth transistor T4 may be provided to be both N-type transistors or both P-type transistors.

In an embodiment, for the first drive transistor M1, a first end thereof is electrically connected to the first node A1, a second end thereof is electrically connected to the third node A3 and a control end thereof is electrically connected to the second node A2. For the second drive transistor M2, a first end thereof is electrically connected to the first node A1, a second end thereof is electrically connected to the third node A3 and a control end thereof is electrically connected to the second node A2.

In an embodiment, for the first transistor T1, a first end thereof is electrically connected to the first power source voltage end Vdd, a second end thereof is electrically connected to the first node A1, and a control end thereof is electrically connected to the light-emitting signal control end Emit.

In an embodiment, for the second transistor T2, a first end thereof is electrically connected to the second node A2, a second end thereof is electrically connected to the polarity switching signal end Vref, and a control end thereof is electrically connected to the first scan signal end Scan1.

Figure 6:
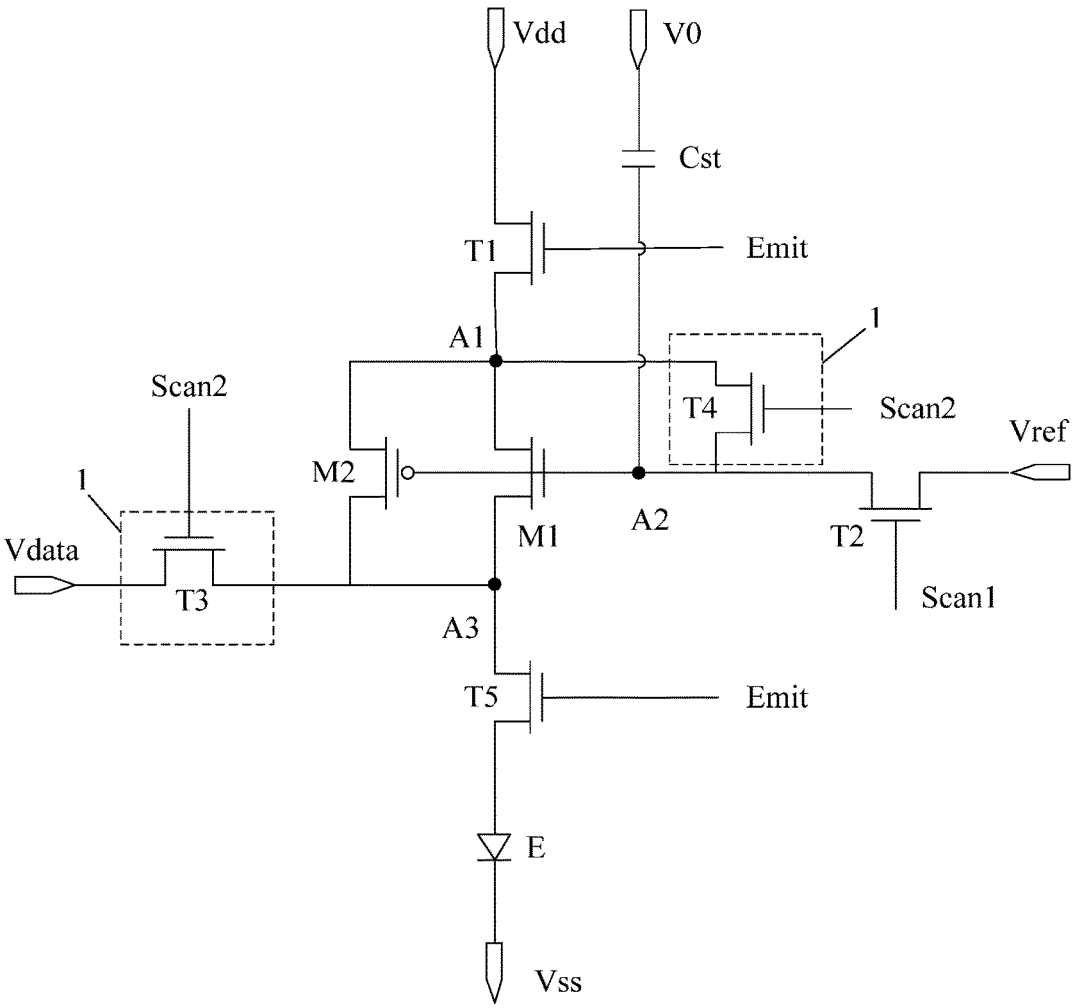
FIG. 6 is a schematic diagram of still another pixel drive circuit in an embodiment of the present invention.
Figure 7:
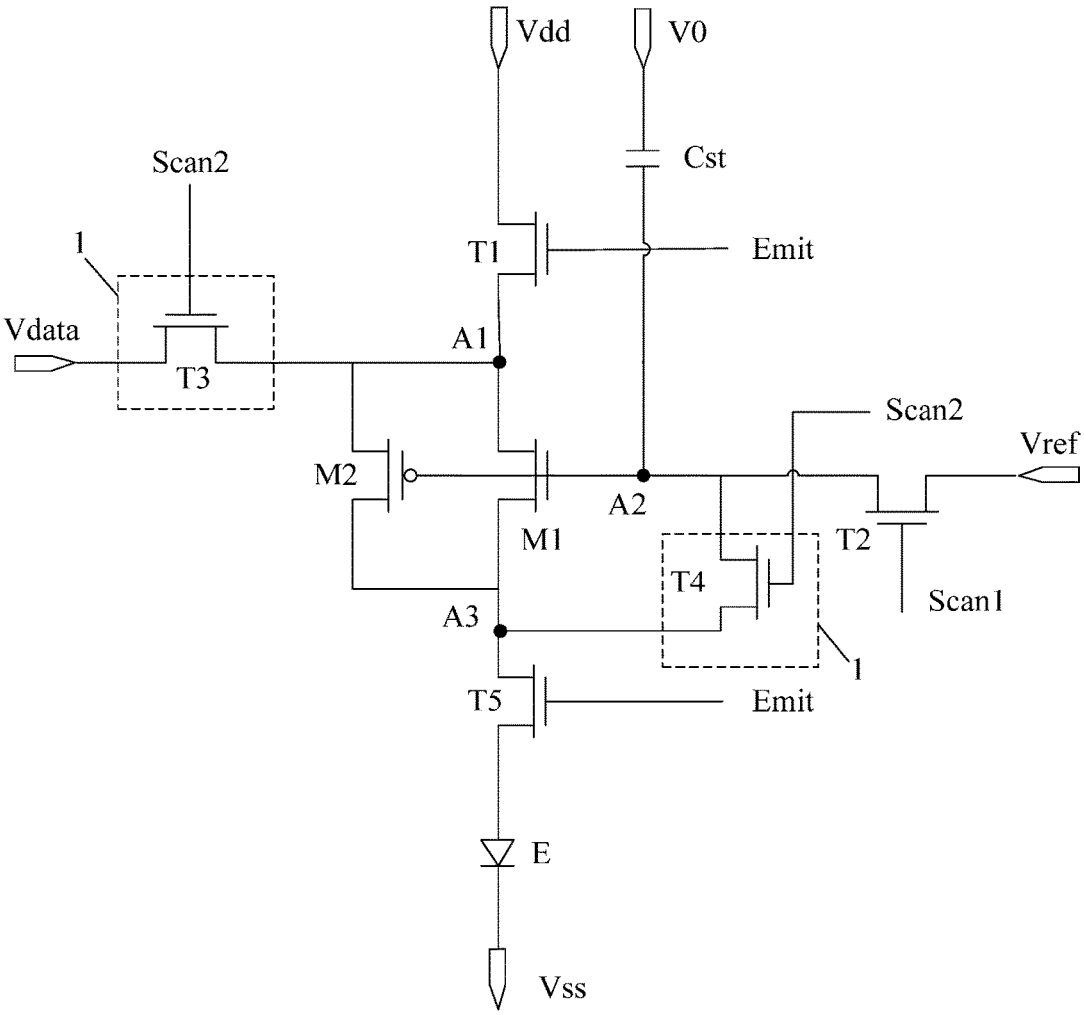
FIG. 7 is a schematic diagram of still another pixel drive circuit in an embodiment of the present invention.

In an embodiment, as shown in FIGS. 6 and 7, FIG. 6 is a schematic diagram of still another pixel drive circuit in an embodiment of the present invention, and FIG. 7 is a schematic diagram of still another pixel drive circuit in an embodiment of the present invention. The pixel drive circuit further includes: a fifth transistor T5, serially connected between the third node A3 and an anode of the light-emitting element E, a first end thereof being electrically connected to the third node A3, a second thereof being electrically connected to the anode of the light-emitting element E, and a control end thereof being electrically connected to the light-emitting signal control end Emit.

The fifth transistor T5 plays the same role as the first transistor T1, and it can be further ensured that in non-light-emitting period, the light-emitting element E and other elements (for example, other transistors) do not affect each other. In the third stage t3, the enable signal is provided to the light-emitting signal control end Emit, and in addition to the first transistor T1, the fifth transistor T5 can also be turned on. Therefore, a conduction path can be established between the anode of the light-emitting element E and the first power source voltage end Vdd, such that the light-emitting element E can normally emit light.

In an embodiment, as shown in FIGS. 3, 5, 6 and 7, a first end of the storage capacitor Cst is electrically connected to the second node A2, and a second end of the storage capacitor Cst is electrically connected to a fixed-potential end V0.

The potential of the fixed-potential end V0 can be provided by a chip. By a fixed potential provided by the fixed-potential end V0 and in cooperation with a bootstrapping action of the storage capacitor Cst per se, a potential maintaining effect for the second node A2 can be realized.

Since the two different types of drive transistors are used to work in different times, by independently setting the additional fixed-potential end V0, the potential of the fixed-potential end V0 can be more conveniently adjusted by actual working conditions of the two drive transistors.

Figure 8:
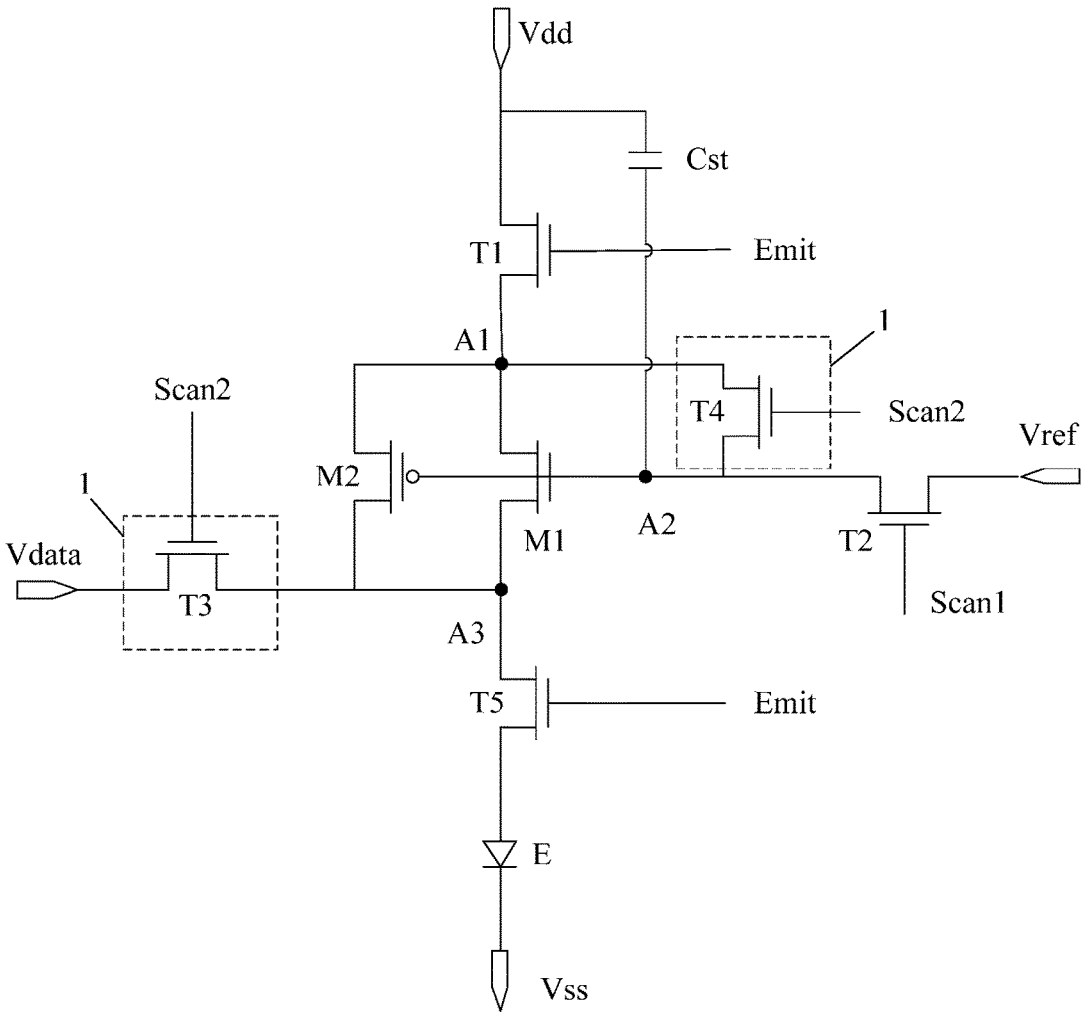
FIG. 8 is a schematic diagram of still another pixel drive circuit in an embodiment of the present invention.

In an embodiment, as shown in FIG. 8, which is a schematic diagram of still another pixel drive circuit in an embodiment of the present invention, a first end of the storage capacitor Cst is electrically connected to the second node A2, and a second end of the storage capacitor Cst is electrically connected to the first power source voltage end Vdd.

The first power source voltage end Vdd may provide the fixed potential to cooperate with the bootstrapping action of the storage capacitor Cst, thereby realizing the potential maintaining effect for the second node A2. Since the first power source voltage end Vdd is reused, there is no need to additionally provide a corresponding fixed-potential end, the cost is reduced and space utilization rate is improved.

In an embodiment, the light-emitting element E is an organic light-emitting diode.

It should be noted that the embodiments of the present invention do not limit the type of the light-emitting element E, and any light-emitting element capable of being applied to the above drive circuit and drive method can serve as the light-emitting element E in the embodiments of the present invention, for example, an organic light-emitting diode or micro light-emitting diode. In addition, the embodiments of the present invention do not limit a control type of the transistors either, it is noted that the transistors herein refer to transistors other than the drive transistors. For example, the first transistor T1 may be an N-type transistor and may be a P-type transistor. When the first transistor T1 is the N-type transistor, in a signal provided by the corresponding light-emitting signal control end Emit, a high level is the enable signal and a low level is the non-enable signal. When the first transistor T1 is the P-type transistor, in a signal provided by the corresponding light-emitting signal control end Emit, the low level is the enable signal and the high level is the non-enable signal.

In an embodiment, as shown in FIG. 4, the first polarity frame Frame1 and the second polarity frame Frame2 are alternately disposed.

FIG. 4 only shows a case of one first polarity frame Frame1 and one second polarity frame Frame2, and when a plurality of first polarity frames Frame1 and a plurality of second polarity frames Frame2 are included, the first polarity frames Frame1 and the second polarity frames Frame2 are alternately disposed. In this way, the first drive transistor M1 and the second drive transistor M2 in each pixel drive circuit are enabled to work alternately, thereby further offsetting the threshold drifting of the first drive transistor M1 and the second drive transistor M2.

In an embodiment, each of the first polarity frame Frame1 and the second polarity frame Frame2 includes a buffer stage t0 before the first stage t1. In the buffer stage to, the non-enable signal is provided to the first scan signal end Scan1, the non-enable signal is provided to the second scan signal end Scan2, and the enable signal is provided to the light-emitting signal control end Emit.

In the buffer stage t0, the polarity switching signal end Vref is switched to the corresponding polarity, which is more favorable for a control action for the corresponding drive transistors in the first stage t1. It should be noted that the first polarity frame Frame1 and the second polarity frame Frame2 as shown in FIG. 4 are two non-continuous frames, i.e., in the first polarity frame Frame1, after the scanning to the last row of light-emitting elements from the first row of light-emitting elements, the buffer stage t0 is firstly entered instead of directly starting the scanning of the first row of light-emitting elements in the second polarity frame Frame2. In the buffer stage to, the first scan signal end Scan1 and the second scan signal end Scan2 of any pixel drive circuit may both provide the non-enable signal, and the data line Vdata may be any signal, which will not affect the display; while the polarity switching signal end Vref needs to be switched to the polarity in advance to ensure that when the scanning of the first row of light-emitting elements is performed for a next time, the polarity switching signal end Vref can directly provide the polarity in the frame. Except for such a manner, the buffer stage t0 may not be provided, i.e., in the first polarity frame Frame1, after the scanning to the last row of light-emitting elements from the first row of light-emitting elements, the second polarity frame Frame2 is firstly entered, the scanning is performed from the first row of light-emitting elements, and so on. It should be noted that in one frame, a scanning sequence for the rows of the light-emitting elements may be the scanning of the odd number rows of light-emitting elements at first and then the even number rows of light-emitting elements, and the present invention does not specifically limit the scanning sequence of the rows of respective light-emitting elements in one frame.

Figure 9:
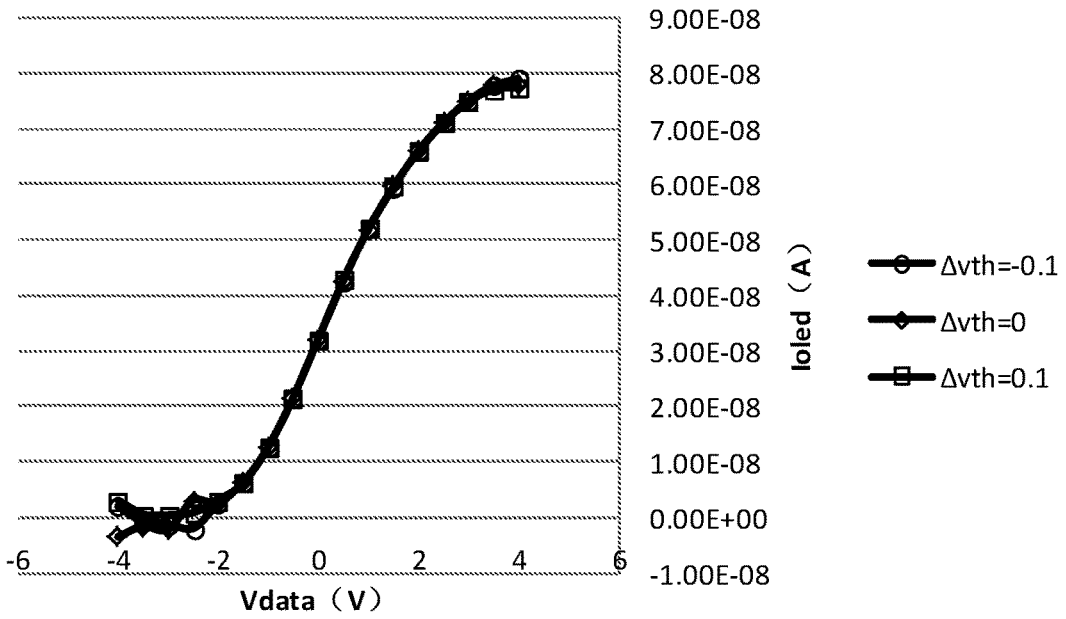
FIG. 9 is a simulation result showing a relation between a drive current holed and a data line signal Vdata in a first polarity frame Frame1 of a pixel drive circuit in an embodiment of the present invention.
Figure 10:
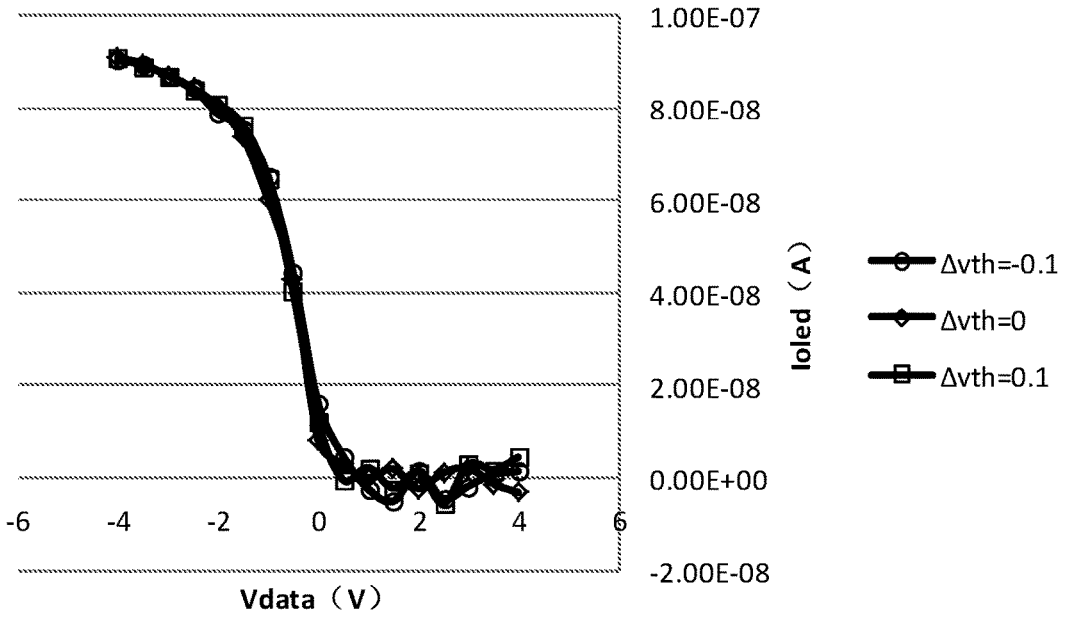
FIG. 10 is a simulation result showing a relation between a drive current Ioled and a data line signal Vdata in a second polarity frame Frame2 of a pixel drive circuit in an embodiment of the present invention.

It should be noted that for the above pixel drive circuit, in the first polarity frame Frame1 and the second polarity frame Frame2, a driving process by using a single first drive transistor M1 and a driving process by using a single second drive transistor M2 may both theoretically offset an influence of the threshold voltage on a drive current, and a principle thereof is the same as an offset principle for the threshold voltage in the related art, which is not repeated herein. As shown in FIGS. 9 and 10, FIG. 9 is a simulation result showing a relation between a drive current Ioled and a data line signal Vdata in the first polarity frame Frame1 of a pixel drive circuit in an embodiment of the present invention, and FIG. 10 is a simulation result showing a relation between a drive current Ioled and a data line signal Vdata in a second polarity frame Frame2 of a pixel drive circuit in an embodiment of the present invention. As shown in FIG. 9, in the first polarity frame Frame1, the polarity switching signal end Vref provides a positive polarity voltage, ΔVth represents a threshold voltage change value of the first drive transistor M1 and the second drive transistor M2, and it can be known that the drive current Ioled is basically unchanged if the threshold voltage is changed. As shown in FIG. 10, in the second polarity frame Frame2, the polarity switching signal end Vref provides a negative polarity voltage, ΔVth represents the threshold voltage change value of the first drive transistor M1 and the second drive transistor M2, and it can be known that the drive current Ioled is basically unchanged if the threshold voltage is changed. It can be known from FIGS. 9 and 10 that the driving process by using a single first drive transistor M1 and the driving process by using a single second drive transistor M2 can both theoretically offset the influence of the threshold voltage on the drive current.

Figure 11:
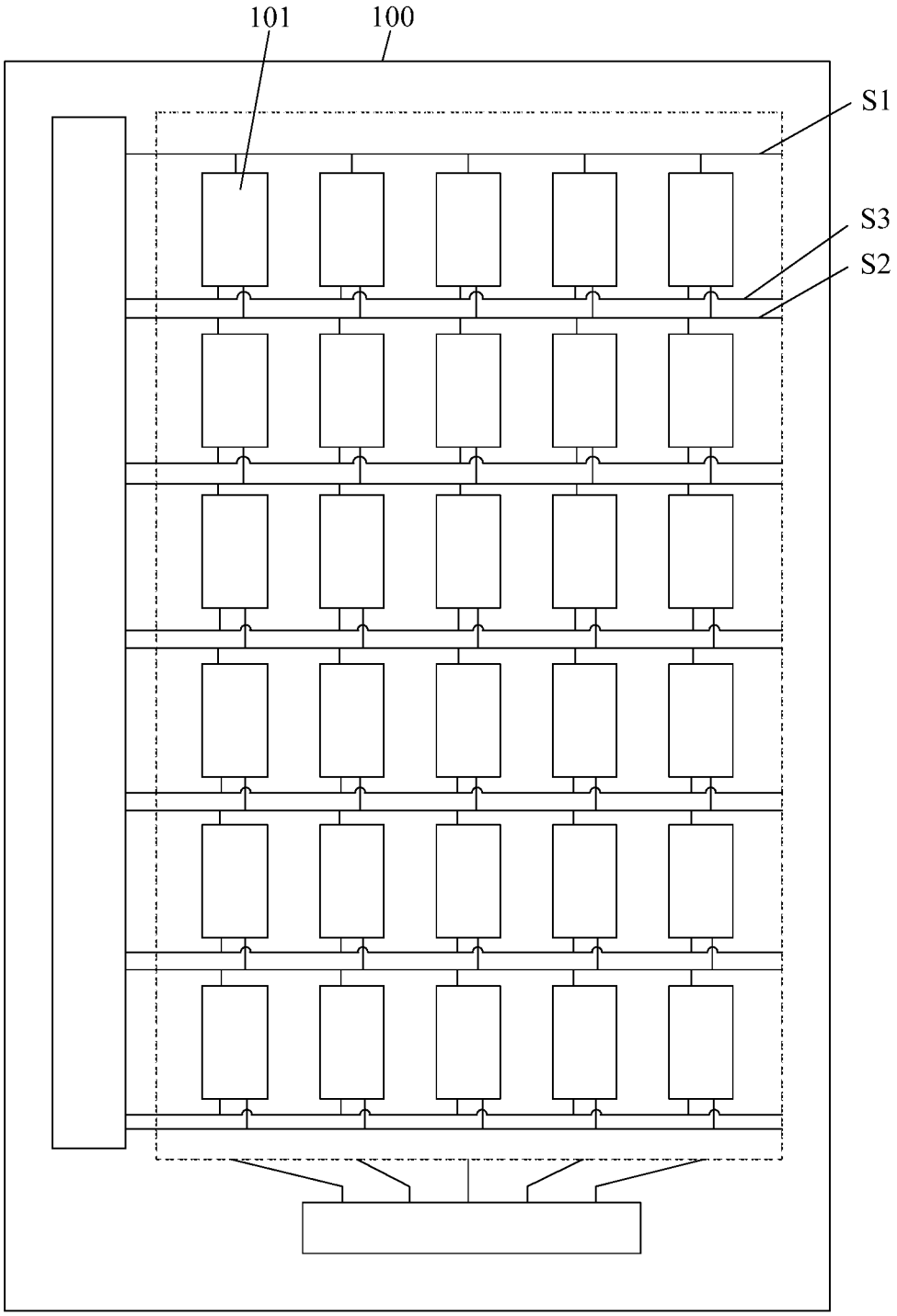
FIG. 11 is a structural schematic diagram of a display panel in an embodiment of the present invention.
Figure 12:
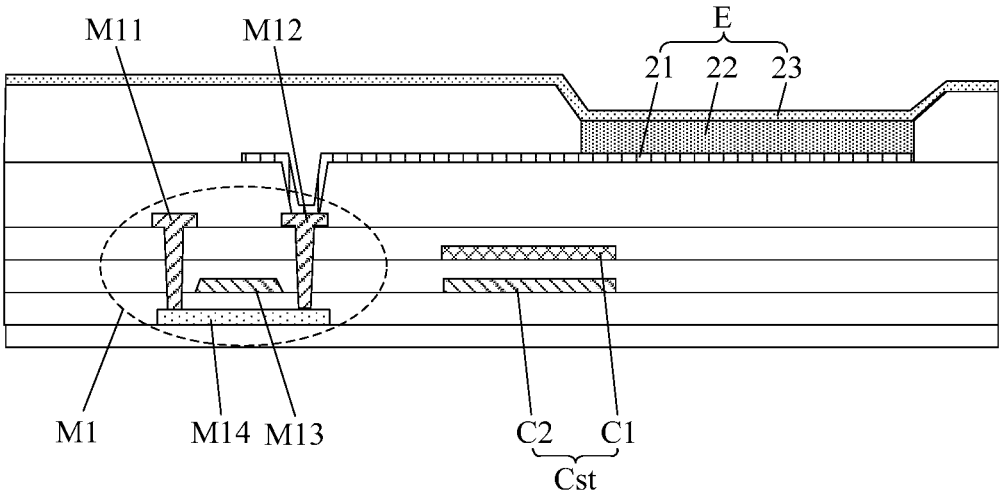
FIG. 12 is a cross-sectional structural schematic diagram of a part of the display panel in FIG. 11.

As shown in FIGS. 11 and 12, FIG. 11 is a structural schematic diagram of a display panel in an embodiment of the present invention; and FIG. 12 is a cross-sectional structural schematic diagram of a part of the display panel in FIG. 11. An embodiment of the present invention also provides a display panel 100, including the above pixel drive circuit.

The display panel includes a plurality of sub-pixels 101 distributed in a matrix, each sub-pixel corresponds to one pixel drive circuit, and each row of sub-pixels corresponds to a first scan line S1, a second scan line S2 and a third scan line S3. The first scan line S1 is used for providing the first scan signal end Scan1 corresponding to said row of sub-pixels, the second scan line S2 is used for providing the second scan signal end Scan2 corresponding to said row of sub-pixels and the first scan signal end Scan1 corresponding to the next row of sub-pixels, and the third scan line S3 is used for providing the light-emitting signal control end Emit corresponding to said row of sub-pixels, that is, two adjacent rows of sub-pixels share one scan signal line. As shown in FIG. 12, for example, each light-emitting element E includes an anode layer 21, a light-emitting layer 22 and a cathode layer 23 which are arranged in sequence. The drive transistor M1 includes a source electrode M11, a drain electrode M12, a gate electrode M13 and an active layer M14. The storage capacitor Cst includes a first electrode plate C1 and a second electrode plate C2, and the gate electrode M13 and the second electrode plate C2 are located on a first metal layer, the first electrode plate C1 is located on a second metal layer, and the source electrode M11 and the drain electrode M12 are located on a third metal layer. The third metal layer, the second metal layer, the first metal layer and the active layer M14 are disposed in sequence arranged on a side of the anode layer 21 away from the cathode layer 23. The drain electrode M12 is connected to the anode layer 21 by a via hole.

It should be noted that FIG. 12 only illustrates the two elements in the pixel drive circuit: the first drive transistor M1 and the storage capacitor Cst, the layer structures of other transistors may be same as the structure of the first drive transistor M1, and the transistor connected to the anode of the light-emitting element E may be adjusted according to a specific connection structure of the pixel drive circuit. For example, the transistor connected to the anode of the light-emitting element E may be the fifth transistor T5. In addition, a relation among respective layer structures is not limited to the structure as shown in FIG. 12, for example, the first electrode plate C1 and the second electrode plate C2 may be manufactured in other layers as long as the two electrode plates of the capacitor are formed. If the light-emitting element E is a top light-emitting structure, that is, the light-emitting element E emits light from a side of the cathode layer 23 away from the anode layer 21, then respective elements in the pixel drive circuit may be disposed below the light-emitting element E; and if the light-emitting element E is a bottom light-emitting structure, that is, the light-emitting element E emits light from a side of the anode layer 21 away from the cathode layer 23, then respective elements in the pixel drive circuit need to be disposed outside a light-emitting region of the light-emitting element E, to ensure no adverse effects on the display.

The specific structure and principle of the pixel drive circuit are same as the above embodiments, and are not repeated here.

According to the display panel in an embodiment of the present invention, two drive transistors can alternately work in different frames. The problem that a same drive transistor being influenced by a bias voltage of a same direction is prevented, such that the probability that the threshold voltage of the drive transistor being consistently drifted toward the same direction is reduced, and the influence on a threshold compensation effect caused by consistent drifting of the threshold voltage of the drive transistor toward the same direction is reduced. Therefore, poor display caused by the consistent drifting of the threshold voltage of the drive transistor toward the same direction is improved.

Figure 13:
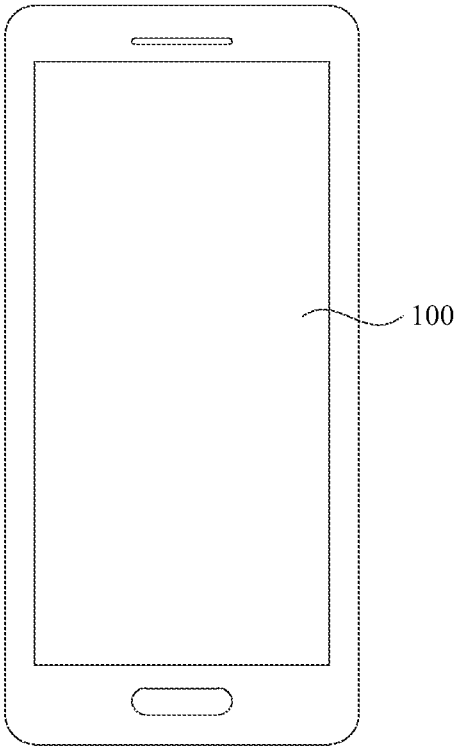
FIG. 13 is a structural schematic diagram of a display device in an embodiment of the present invention.

As shown in FIG. 13, which is a structural schematic diagram of a display device in an embodiment of the present invention, an embodiment of the present invention provides a display device, including the above display panel 100.

The display device may be any electronic device having a display function, such as a touch display screen, a cellphone, a tablet computer, a laptop or a television.

According to the display device in an embodiment of the present invention, two drive transistors can alternately work in different frames. The problem that a same drive transistor being influenced by a bias voltage of a same direction is prevented, such that the probability that the threshold voltage of the drive transistor being consistently drifted toward the same direction is reduced, and the influence on a threshold compensation effect caused by consistent drifting of the threshold voltage of the drive transistor toward the same direction is reduced. Therefore, poor display caused by the consistent drifting of the threshold voltage of the drive transistor toward the same direction is improved.

Finally it should be noted that the above embodiments are merely intended to explain the technical solutions of the present invention rather than limitations thereof. Although the present invention is explained in detail with reference to the foregoing respective embodiments, those skilled in the art should understand that the technical solutions recorded in the foregoing respective embodiments can still be modified, or all or part of technical features therein can be equivalently substituted; while these modifications or substitutions do not let the essence of the corresponding technical solutions depart from the scope of the technical solutions of the respective embodiments of the present invention.

What is claimed is:

1. A pixel drive circuit, comprising:

a first transistor, configured to transmit a signal of a first power source voltage end to a first node in response to an enable signal of a light-emitting signal control end;

a first drive transistor, configured to generate a drive current on a conduction path from the first node to a third node according to an enable signal of a second node, the first drive transistor being an N-type transistor;

a second drive transistor, configured to generate a drive current on the conduction path from the first node to the third node according to an enable signal of the second node, the second drive transistor being a P-type transistor;

a storage capacitor, configured to maintain a voltage of the second node;

a second transistor, configured to transmit a signal of a polarity switching signal end to the second node in response to an enable signal of a first scan signal end;

a compensation module, configured to enable a signal of a data line to flow to the second node passing through the first drive transistor or the second drive transistor in response to an enable signal of a second scan signal end; and a light-emitting element, an anode of the light-emitting element being coupled to the third node, and a cathode of the light-emitting element being electrically connected to a second power source voltage end.

2. The pixel drive circuit according to claim 1, wherein the compensation module comprises:

a third transistor, a first end of the third transistor being electrically connected to the data line, a second end of the third transistor being electrically connected to the third node, and a control end of the third transistor being electrically connected to the second scan signal end and configured to transmit the signal of the data line to the third node in response to the enable signal of the second scan signal end; and a fourth transistor, a first end of the fourth transistor being electrically connected to the first node, a second end of the fourth transistor being electrically connected to the second node, and a control end of the fourth transistor being electrically connected to the second scan signal end and configured to conduct the first node and the second node in response to the enable signal of the second scan signal end.

3. The pixel drive circuit according to claim 1, wherein the compensation module comprises:

a third transistor, a first end of the third transistor being electrically connected to the data line, a second end of the third transistor being electrically connected to the first node, and a control end of the third transistor being electrically connected to the second scan signal end and configured to transmit the signal of the data line to the first node in response to the enable signal of the second scan signal end; and a fourth transistor, a first end of the fourth transistor being electrically connected to the third node, a second end of the fourth transistor being electrically connected to the second node, and a control end of the fourth transistor being electrically connected to the second scan signal end and configured to conduct the third node and the second node in response to the enable signal of the second scan signal end.

4. The pixel drive circuit according to claim 1, wherein a first end of the first drive transistor is electrically connected to the first node, a second end of the first drive transistor is electrically connected to the third node and a control end of the first drive transistor is electrically connected to the second node; and a first end of the second drive transistor is electrically connected to the first node, a second end of the second drive transistor is electrically connected to the third node and a control end of the second drive transistor is electrically connected to the second node.

5. The pixel drive circuit according to claim 1, wherein a first end of the first transistor is electrically connected to the first power source voltage end, a second end of the first transistor is electrically connected to the first node, and a control end of the first transistor is electrically connected to the light-emitting signal control end.

6. The pixel drive circuit according to claim 1, wherein a first end of the second transistor is electrically connected to the second node, a second end of the second transistor is electrically connected to the polarity switching signal end, and a control end of the second transistor is electrically connected to the first scan signal end.

7. The pixel drive circuit according to claim 1, further comprising a fifth transistor, serially connected between the third node and the anode of the light-emitting element, a first end of the fifth transistor being electrically connected to the third node, a second end of the fifth transistor being electrically connected to the anode of the light-emitting element, and a control end of the fifth transistor being electrically connected to the light-emitting signal control end.

8. The pixel drive circuit according to claim 1, wherein a first end of the storage capacitor is electrically connected to the second node, and a second end of the storage capacitor is electrically connected to a fixed-potential end.

9. The pixel drive circuit according to claim 1, wherein a first end of the storage capacitor is electrically connected to the second node, and a second end of the storage capacitor is electrically connected to the first power source voltage end.

10. The pixel drive circuit according to claim 1, wherein the light-emitting element is an organic light-emitting diode.

11. A display device, comprising:

a display panel, comprising:

a pixel drive circuit, wherein the pixel drive circuit comprises:

a first transistor, configured to transmit a signal of a first power source voltage end to a first node in response to an enable signal of a light-emitting signal control end;

a first drive transistor, configured to generate a drive current on a conduction path from the first node to a third node according to an enable signal of a second node, the first drive transistor being an N-type transistor;

a second drive transistor, configured to generate a drive current on the conduction path from the first node to the third node according to an enable signal of the second node, the second drive transistor being a P-type transistor;

a storage capacitor, configured to maintain a voltage of the second node;

a second transistor, configured to transmit a signal of a polarity switching signal end to the second node in response to an enable signal of a first scan signal end;

a compensation module, configured to enable a signal of a data line to flow to the second node passing through the first drive transistor or the second drive transistor in response to an enable signal of a second scan signal end; and a light-emitting element, an anode of the light-emitting element being coupled to the third node, and a cathode of the light-emitting element being electrically connected to a second power source voltage end.

12. A control method for a pixel drive circuit, applied in a pixel drive circuit, wherein the pixel drive circuit comprises:

a first transistor, configured to transmit a signal of a first power source voltage end to a first node in response to an enable signal of a light-emitting signal control end;

a first drive transistor, configured to generate a drive current on a conduction path from the first node to a third node according to an enable signal of a second node, the first drive transistor being an N-type transistor;

a second drive transistor, configured to generate a drive current on the conduction path from the first node to the third node according to an enable signal of the second node, the second drive transistor being a P-type transistor;

a storage capacitor, configured to maintain a voltage of the second node;

a second transistor, configured to transmit a signal of a polarity switching signal end to the second node in response to an enable signal of a first scan signal end;

a compensation module, configured to enable a signal of a data line to flow to the second node passing through the first drive transistor or the second drive transistor in response to an enable signal of a second scan signal end; and a light-emitting element, an anode of the light-emitting element being coupled to the third node, and a cathode of the light-emitting element being electrically connected to a second power source voltage end;

wherein the method comprises:

providing, in a first polarity frame, a first polarity voltage to the polarity switching signal end; wherein the first polarity frame sequentially comprises a first stage, a second stage and a third stage;

providing, in a second polarity frame, a second polarity voltage with a polarity opposite to the first polarity voltage to the polarity switching signal end; wherein the second polarity frame sequentially comprises a first stage, a second stage and a third stage;

providing, in the first stage, an enable signal to the first scan signal end, a non-enable signal to the second scan signal end, and a non-enable signal to the light-emitting signal control end;

providing, in the second stage, a non-enable signal to the first scan signal end, an enable signal to the second scan signal end, and a non-enable signal to the light-emitting signal control end; and providing, in the third stage, a non-enable signal to the first scan signal end, a non-enable signal to the second scan signal end, and an enable signal to the light-emitting signal control end.

13. The method according to claim 12, wherein the first polarity frame and the second polarity frame are disposed alternately.

14. The method according to claim 13, wherein each of the first polarity frame and the second polarity frame further comprises a buffer stage before the first stage; and the method further comprises:

providing, in the buffer stage, a non-enable signal to the first scan signal end, a non-enable signal to the second scan signal end, and an enable signal to the light-emitting signal control end.

* * * * *